United States Patent [19]

Hollinger et al.

[11] Patent Number: 4,969,648

[45] Date of Patent: Nov. 13, 1990

[54] APPARATUS AND METHOD FOR AUTOMATICALLY SHUFFLING CARDS

[75] Inventors: Robert A. Hollinger, Warrington; Daniel Rosenberg, Hatfield; John C. Schisselbauer, Southampton, all of Pa.

[73] Assignee: Peripheral Dynamics, Inc., Plymouth Meeting, Pa.

[21] Appl. No.: 257,337

[22] Filed: Oct. 13, 1988

[51] Int. Cl.[5] ..... A63F 1/12

[52] U.S. Cl. ..... 273/149 R

[58] Field of Search ..... 273/149 R, 149 P, 138, 273/138 A, 148

[56] References Cited

U.S. PATENT DOCUMENTS

| | | | |
|---|---|---|---|
| 4,497,488 | 2/1985 | Plevyak et al. | 273/149 R |
| 4,513,969 | 4/1985 | Samsel, Jr. | 273/149 R |
| 4,515,367 | 5/1985 | Howard | 273/149 R |
| 4,586,712 | 5/1986 | Lorber et al. | 273/149 R |
| 4,750,743 | 6/1988 | Nicoletti | 273/149 R |
| 4,770,421 | 9/1988 | Hoffman | 273/149 R |
| 4,807,884 | 2/1989 | Breeding | 273/149 R |

*Primary Examiner*—Edward M. Coven
*Assistant Examiner*—Jessica J. Harrison
*Attorney, Agent, or Firm*—Woodcock Washburn Kurtz Mackiewicz & Norris

[57] ABSTRACT

An apparatus and method are provided for detecting malfunctions in an automatic card shuffler device of the type which randomly extracts cards from two or more storage wells. Detection is accomplished by sensing the failure of a card to be extracted for a storage well and counting the number of successive failures from each storage well. When the number of successive extraction failures associated with any one storage well reaches a predetermined value, an alarm is activated.

14 Claims, 3 Drawing Sheets

APPARATUS AND METHOD FOR AUTOMATICALLY SHUFFLING CARDS

BACKGROUND OF THE INVENTION

1. Field of the Invention

The present invention relates to automatic card shufflers, and more particularly to a device capable of continuously shuffling several decks of playing cards and notifying the user should a malfunction result in the delivery of unshuffled cards.

2. Description of the Prior Art

Devices capable of automatically shuffling playing cards and adapted for use in the gaming tables of gambling casinos have been known for some time. One such device, disclosed in U.S. Pat. No. 4,513,969, performs the shuffling function by randomly extracting cards from either of two storage wells, each containing a large supply of unshuffled cards, and delivering them to a dispenser from which the dealer draws. However, a disadvantage of such devices is that dirt deposited on the surfaces of the cards by the players is often transferred to the extraction mechanism, impairing its functioning and resulting in a consistent failure to extract cards from one of the storage wells. Although such faulty extraction can usually be easily remedied by cleaning the extraction mechanism, under the prior art the dealer had no way of knowing of the situation. Thus, card sequences from previous hands can reoccur, compromising the unpredictability of the cards dealt. It is desirable, therefore, to provide a card shuffler device which will alert the dealer should unsuccessful extractions from one of the storage wells occur with a predetermined degree of consistency.

SUMMARY OF THE INVENTION

It is the object of the invention to provide an automatic card shuffler device of the type employing a plurality of storage wells, from which cards are extracted on a random basis, and incorporating means for detecting malfunctions which compromise the shuffling ability of the device. Specifically, it is an object of the invention to provide apparatus and method for detecting detect consistently unsuccessful attempts to extract a card from one of the storage wells.

It is another object of the invention to alert the dealer to a malfunction, so that corrective action can be taken.

It is still another object of the invention to avoid unnecessarily interrupting the use of the card shuffler by ignoring unsuccessful extractions which do not occur with sufficient frequency to compromise the unpredictability of the cards delivered by the shuffler.

These and other objects are accomplished in a card shuffler having a plurality of storage wells from which cards are extracted on a random basis and transported to a reservoir to await dispensing to the dealer. Malfunctions are detected by sensing the entry of cards into the reservoir, and using counters to keep track, for each storage well, of the number of times the sensing mechanism fails to detect the entry of a card into the reservoir within a predetermined period of time after an electronic controller directs an extraction mechanism to extract a card from that storage well. When the count for any storage well reaches a predetermined number, an alarm is activated, thereby alerting the dealer to the malfunction.

DESCRIPTION OF THE PREFERRED EMBODIMENT

Figure 1:
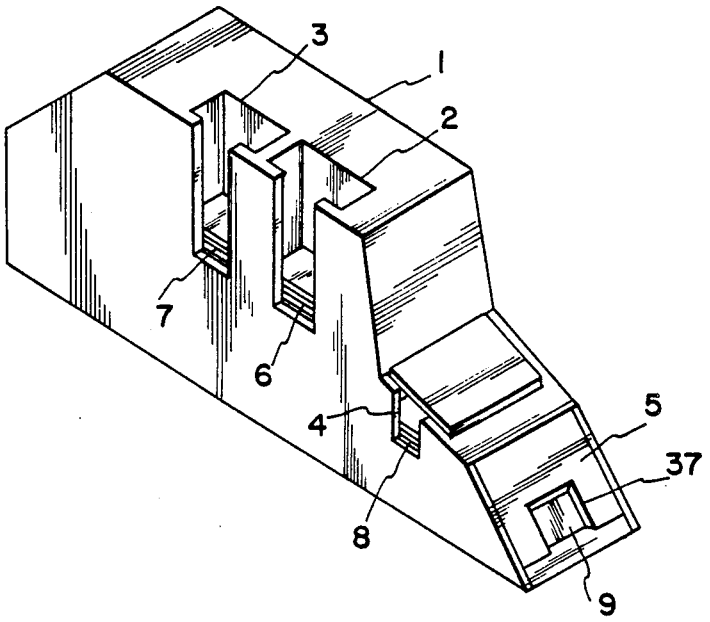
FIG. 1 is a perspective view of the card shuffler of this invention.

There is shown in FIG. 1 the card shuffler device which is the subject of the current invention. A housing 1 encases the shuffler device and forms front and rear storage wells 2 and 3. The storage wells are sized so that each can hold several decks of playing cards 6 and 7. Also shown in FIG. 1 is a reservoir 4 which is sized to hold approximately one deck of playing cards 8 and a dispenser 5 which holds one card 9.

Figure 2:
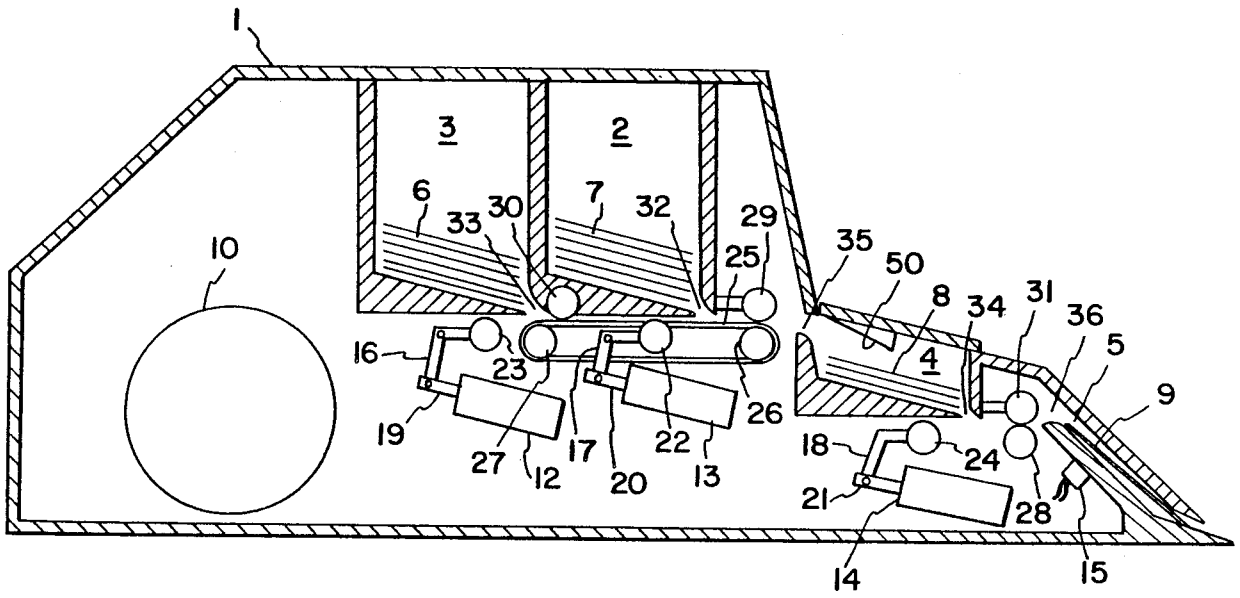
FIG. 2 is a longitudinal cross-section of the card shuffler of FIG. 1.

Referring now to FIG. 2, it can be seen that the internal mechanism of the shuffler device comprises a motor 10 which operates a series of drive and speed reduction pulleys and belts (not shown). Under the storage wells 2 and 3 and the reservoir 4 are solenoids 12, 13 and 14. The shafts 19, 20 and 21 of these solenoids are connected through respective linkages 16, 17 and 18 to respective wheels 22, 23 and 24, which are driven by the motor through pulleys (not shown). A transport belt 25, driven by pulleys 26 and 27, is disposed under the front storage well 2 and operates in combination which idler wheels 29 and 30. Transport wheel pair 28 is disposed between the reservoir 4 and the dispenser 5 and operates in combination with idler wheels 31.

As shown in FIG. 2, exit slits 32 and 33 are formed by gaps between the floors and front walls of storage wells 2 and 3, respectively. A similar exit slit 34 is formed by a gap between the floor and front wall of the reservoir 4. In addition, entry slits 35 and 36 are formed in the reservoir 4 and the dispenser 9, respectively, by gaps between the ceiling and housing.

Still referring to FIG. 2, it can be seen that a sensor 15, suitably a microphotosensor, is disposed in the rear wall of the dispenser 9. In addition, a sensor 50, which can be a mechanically activated photo-sensor switch, is disposed in the ceiling of the reservoir 4.

Further mechanical details of automatic card shufflers of the type shown in FIGS. 1 and 2 are disclosed in U.S. Pat. No. 4,513,969, incorporated herein by reference.

Operation of the shuffler is begun by loading cards, which can be unshuffled cards from earlier play, into the front and rear storage wells, 2 and 3. Optimally, about three hundred cards should be loaded into each well. If the level of cards in reservoir 4 drops below a predetermined level, this is detected by sensor 50 which causes an electronic controller, denoted 46 in FIG. 3, to generate successive signals which randomly energize solenoids 12 and 13. The energizing of solenoid 13 retracts its shaft 20 causing linkage 17 to pivot, thereby causing extraction wheel pair 22 to penetrate through an opening, not shown, in the floor of the front storage well 2 and contact the bottom-most card. Extraction wheels 22 are driven through belts and pulleys by the motor, hence contact with the wheel results in the bottom-most card being ejected from the storage well, through slit 32, and deposited onto the transport belt 25. The transport belt, also driven through belts and pulleys by the motor, delivers the card, with the aid of idler wheel 29, into the reservoir 4 through slit 35. Solenoid 13 is energized for a period of time sufficient to extract one card from the front storage well. In a similar manner, the energizing of solenoid 12, through the interaction of shaft 19, linkage 16 and extraction wheel 23, causes a card to be extracted from the rear storage well 3 and transported on belt 25 to the reservoir 4. Thus, cards are randomly extracted from the storage wells and loaded into the reservoir.

Loading of the reservoir continues in the manner described above until the stack of shuffled cards in the reservoir 4 is sufficiently high to activate reservoir sensor 50. Sensor 50 is suitably a combination phototransmitter-detector, mounted with a vane that moves up and down with the top of the stack of cards, and being set to change its output signal when the stack height passes a predetermined level. Optimally, sensor 50 is set to be activated by the presence of about 52 cards in the reservoir. Activation of sensor 50 discontinues further loading of the reservoir until, as discussed below, a card or two are removed from the dispenser 5, such that a lower stack level is sensed in the reservoir. After loading of the reservoir as discussed above, regular operation of the shuffler can begin.

When dispenser sensor 15 senses that there is no card in the dispenser 5, it causes the energizing of reservoir solenoid 14 which, through the interaction of shaft 21, linkage 18 and extraction wheel 24 shown in FIG. 2, ejects the bottom most card in the reservoir through slit 34 in a manner similar to that discussed above for extraction of cards from storage wells 2 and 3. Note that solenoid 14 is energized only long enough to extract one card. The card thus extracted is transported to the dispenser 5 through slit 36 by transport wheel 28, driven through belts and pulleys by the motor 10, in cooperation with idler wheel 31.

Each time the dealer removes a card 9 from the dispenser 5 through opening 37, shown in FIG. 1, the process above is repeated by the activation of sensor 15, and a new card is extracted from the reservoir and transported to the dispenser.

Figure 3:
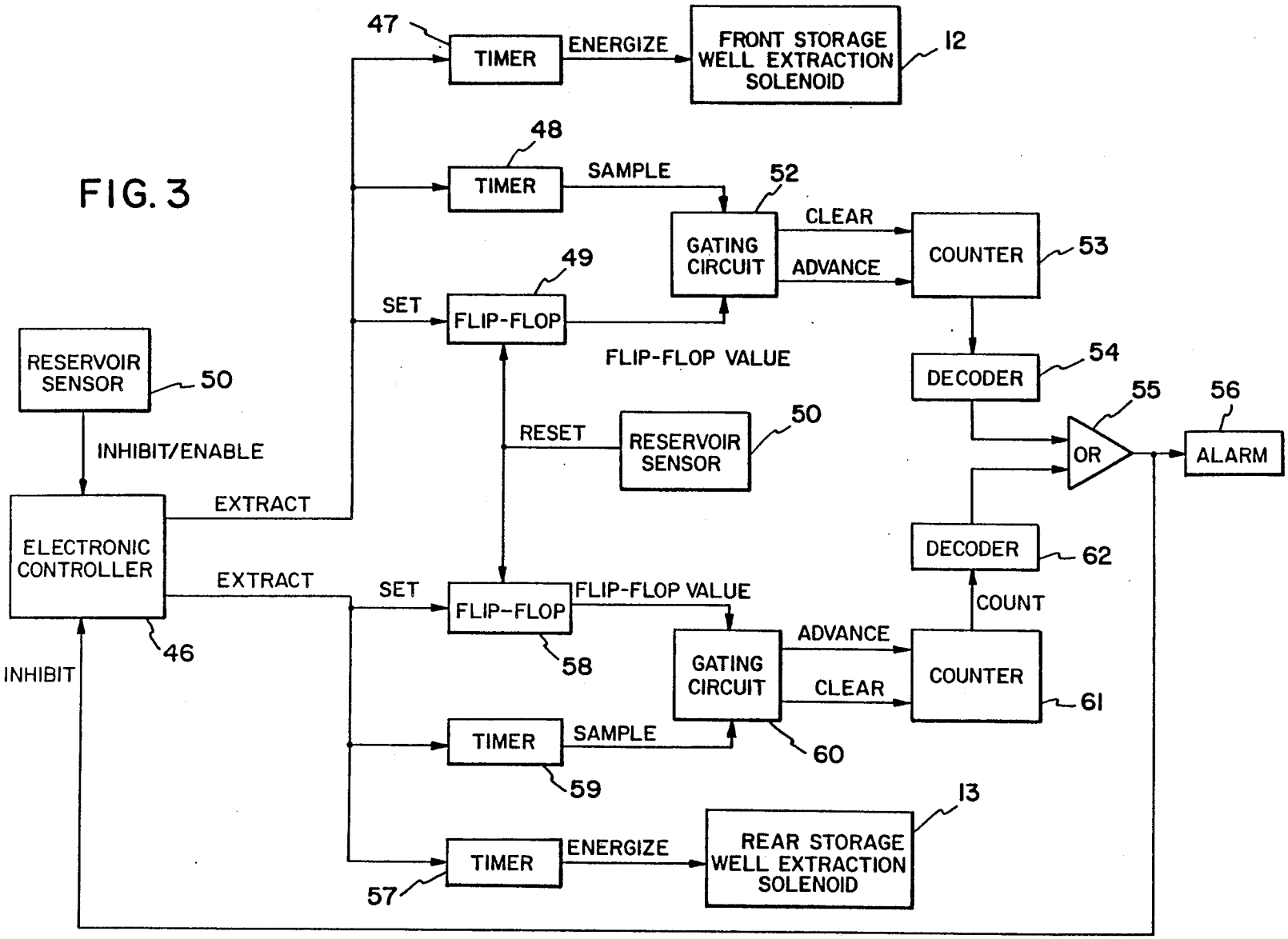
FIG. 3 is a block diagram of the portion of the control circuitry of the card shuffler which is the subject of the current invention.

FIG. 3 is a block diagram of the electronic control circuitry which is suitably housed within housing 1. The circuitry may be battery powered, or connected to a power line (with suitable power supply). Referring to FIG. 3, when reservoir sensor 50 senses that the stack level is low, because cards have been extracted from the reservoir and delivered to the dispenser as explained above, it generates a signal which enables the electronic controller 46, which functions as a random signal generator, to generate an extraction signal selecting either the front or rear storage wells on a random basis. In other words, a drive signal is placed on one, but only one of the two outputs of controller 46, on a random selection basis. If the front storage well is selected, the extraction signal triggers timer 47 which can be a monostable multivibrator or other suitable circuit which generates a pulse of predetermined duration when triggered. The output of timer 47 energizes solenoid 12 for a period of time sufficient to eject only the bottom-most card from the well. The extracted card is transported to the reservoir 4 in the manner previously discussed. Hence, each time the dealer draws a card from the dispenser it is replaced by a card from the reservoir 4; in turn, the reservoir is replenished by a card from one of the storage wells, the particular storage well selected in each draw being determined on a random basis so that the cards in the reservoir always represent a deck of intermixed cards from the two storage wells. When the replenishment of cards in the reservoir has raised the level of the stack in the reservoir to a sufficient height, sensor 50 is activated, as previously explained, and inhibits electronic controller 46 from generating further extraction signals.

As previously discussed, dirt transferred from the surface of the cards onto the extraction wheels 22 and 23 or slight misalignments in the extraction mechanism might result in a tendency for the extraction mechanism of one of the storage wells to fail to extract a card when selected by the electronic controller. If this occurs consistently, operation of the shuffler will result in cards merely being transferred to the reservoir from one of the storage wells, i.e, the one with the correctly functioning extraction mechanism, without any shuffling.

Thus, according to the invention, each time the electronic controller 46 generates a signal to extract a card from the front storage well 2, the extraction signal sets a flip-flop circuit 49 and triggers a timer 48, as shown in FIG. 3. The flip-flop circuit can be any suitable bistable device capable of assuming one of two stable output states depending on the input signal received. The reservoir sensor 50 is momentarily activated by the entry of a card into the reservoir 4 and generates an output signal which resets flip-flop 49. Note that the normal reservoir sensor signal is a steady state high or low signal. When a card enters the reservoir, changing the height of the stack, there is a transient interruption signal generated. This interruption signal is used to reset the flip-flop. The controller 46, however, is not responsive to the interruption signal, but only to the steady state high or low output of sensor 50. The expiration of the output of timer 48 triggers a gating circuit 52 to sample the output of flip-flop 49. The gating circuit will generate a signal to advance or clear a counter 53 depending on whether the flip-flop is in its set or reset state, respectively, when sampled. The duration of the output pulse of timer 48 is set to allow sufficient time for a card to be extracted from the storage well and transported to the reservoir, thereby activating the reservoir sensor 50, if the mechanism is functioning properly. Thus, a failure of the extraction mechanism results in flip-flop 49 still being in its set state when sampled by the gating circuit, thereby resulting in the counter being advanced by one. Should the flip-flop be in its reset state when sampled, indicating a card reached the reservoir within the allotted time, the counter is cleared and the count begun again. When counter 53, which can be of the modulo-N type, reaches a predetermined number, N, decoder 54 causes an output signal to be generated to activate the alarm.

A similar arrangement is provided for the rear storage well 3, as shown in FIG. 3, by flip-flop 58, timer 59, gating circuit 60, counter 61 and decoder 62. The output signals of the front storage well counter 53 and the rear storage well counter 61 are fed to OR gate 55 so that alarm 56, which can be an LED indicator, is activated should either counter reach its predetermined number. Activation of the alarm alerts the dealer that the shuffling function of the device has been compromised. The output of OR gate 55 also provides an inhibit signal to the electronic controller 46 so that no further extractions from the storage wells are attempted. However, there are sufficient cards in the reservoir to allow the current play to continue. After completion of play, the malfunction can be rectified, for example, by cleaning the extraction wheels.

It has been determined by experimentation that genuine malfunctions of the extraction mechanism, as opposed to occasional insignificant instances of a failure to extract, result in at least four or five extraction failures in succession. Hence, to avoid unnecessary interruption of the operation of the shuffler, in the preferred embodiment modulo-8 counters are utilized so that eight successive failures of a card to reach the reservoir from one of the storage wells results in an alarm. Of course, within the scope of this invention other logic schemes can be implemented for determining when a consistent malfunction has occurred, e.g., x failures in y attempts. As claimed, consistent failure to extract includes counting a predetermined number of extraction failures, or any other logic scheme that is implemented.

We claim:

1. A device for automatically shuffling playing cards comprising:

(a) a housing defining a plurality of storage wells and a reservoir, said storage wells and said reservoir adapted to hold playing cards;

(b) extraction means for extracting said cards from said storage wells one at a time, said extraction means having transport means for transporting said extracted cards to said reservoir;

(c) an electronic controller for generating signals to activate said extraction means, said electronic controller having means for varying said activation signals so as to randomly select the one of said storage wells on which said extraction means operates; and (d) detector means for detecting the consistent failure of said extraction means to extract one of said cards from one of said storage wells when selected to do so by said electronic controller, said detector means having determining means for determining that the failure of one of said cards to be transported to said reservoir within a predetermined period of time after said electronic controller has generated one of said extraction signals has consistently occurred.

2. A device for automatically shuffling playing cards comprising:

(a) a housing defining a plurality of storage wells and a reservoir, said storage wells and said reservoir adapted to hold playing cards;

(b) extraction means for extracting said cards from said storage wells one at at time, said extraction means having transport means for transporting said extracted cards to said reservoir;

(c) an electronic controller for generating signals to activate said extraction means, said electronic controller having means for varying said activation signals to as to randomly select the one of said storage wells on which said extraction means operates; and (d) detector means for detecting the consistent failure of said extraction means to extract one of said cards from one of said storage wells when selected to do so by said electronic controller, said detector means having determining means for determining that the failure of one of said cards to be transported to said reservoir within a predetermined period of time after said electronic controller has generated one of said extraction signals has occurred a predetermined number of times.

3. The device according to claim 2, wherein said detector means further comprises sensing means for sensing the transport of one of said cards by said transport means, said sensing means having means for generating a signal when said transport of one of said cards is sensed.

4. The device according to claim 3 wherein said detector means further comprises data storage means, said data storage means adapted to store data whose state is representative of whether said sensing means has sensed the transport of one of said cards.

5. The device according to claim 4 wherein said detector means further comprises sampling means for sampling said state of said data stored in said data storage means a predetermined period of time after said electronic controller generates said signal to activate said extraction means.

6. A device for automatically shuffling playing cards comprising:

(a) a housing defining a plurality of storage wells, said storage wells adapted to hold playing cards;

(b) extraction means for extracting said cards from said storage wells one at at time, said extracting means having transport means for transporting said cards extracted from said storage wells;

(c) an electronic controller for generating signals to activate said extraction means, said electronic controller having means for varying said activation signals so as to randomly select the one of said storage wells on which said extraction means operates; and (d) detector means for detecting the consistent failure of said extraction means to extract a card from one of said storage wells when selected to do so by said electronic controller, said detector means having sensing means for sensing the transport of one of said cards by said transport means, said sensing means having means for generating a signal when said transport of one of said cards is sensed, said detector means having data storage means adapted to store whose state is representative of whether said sensing means has sensed the transport of one of said cards, said data storage means having a flip-flop circuit into which said extraction signal generated by said electronic controller and said signal generated by said sensing means are received, the state assumed by said flip-flop circuit being dependent on which of said signals it received last.

7. A device for automatically shuffling playing cards comprising:

(a) a housing defining a plurality of storage wells, said storage wells adapted to hold playing cards;

(b) extraction means for extracting said cards from said storage wells one at a time, said extraction means having transport means for transporting said cards extracted from said storage wells;

(c) an electronic controller for generating signals to activate said extraction means, said electronic controller having means for varying said activation signals so as to randomly select the one of said storage wells on which said extraction means operate; and (d) detector means for detecting the consistent failure of said extraction means to extract a card from one of said storage wells when selected to do so by said electronic controller, said detector means having sensing means for sensing the transport of one of said cards by said transport means, said sensing means having means for generating a signal when said transport of one of said cards is sensed, said detector means having data storage means adapted to store data whose state is representative of whether said sensing means has sensed the transport of one of said cards, said detector means having sampling means for sampling said state of said data store in said data storage means a predetermined period of time after said electronic controller generates said signal to activate said extraction means, said sampling means having timer means, said timer means having means for generating a triggering signal a predetermined period of time after said electronic controller generates said signal to activate said extraction means.

8. The device according to claim 7 wherein said sampling means further comprises a gating circuit into which said triggering signal generated by said timer means and said state of said data sampled are received, said gating circuit having an output representative of said state of said data sampled when said triggering signal from said timer means is received.

9. A device for automatically shuffling playing cards comprising:

(a) a housing defining a plurality of storage wells, said storage wells adapted to hold playing cards;

(b) extraction means for extracting said cards from said storage wells one at at time, said extraction means having transport means for transporting said cards extracted from said storage wells;

(c) an electronic controller for generating signals to activate said extraction means, said electronic controller having means for varying said activation signals so as to randomly select the one of said storage wells on which said extraction means operates; and (d) detector means for detecting the consistent failure of said extraction means to extract a card from one of said storage wells when selected to do so by said electronic controller, said detector means having sensing means for sensing the transport of one of said cards by transport means, said sensing means having means for generating a signal when said transport of one of said cards is sensed, said detector means having data storage means adapted to store data whose state is representative of whether said sensing means has sensed the transport of one of said cards, said detector means having sampling means for sampling said state of said data stored in said data storage means a predetermined period of time after said electronic controller generates said signal to activate said extraction means, said detector means having counter means for counting the number of times said state of said data sampled by said sampling means has been representative of said sensing means not having sensed the transport of one of said cards.

10. The device according to claim 9 wherein said counter means further comprises means for initializing said count when said count reaches a predetermined number.

11. The device according to claim 9 further comprising alarm means for generating an alarm when said count reaches a predetermined number.

12. The device according to claim 9 wherein said data storage means, said sampling means and said counter means comprise separate means for each of said storage wells, whereby a separate count is maintained in one of said counter means for each of said storage wells, said count for each storage well representing the number of times said sensing means did not sense the transport of one said cards a predetermined period of time after said electronic controller generated a signal for said extraction means to operate on the same said storage well.

13. A method for automatically shuffling playing cards comprising:

(a) storing a plurality of playing cards in a plurality of storage wells;

(b) randomly selecting one of said storage wells;

(c) applying an extraction mechanism to said storage well selected in step (b), said extraction mechanism capable of extracting one of said cards from said storage well when functioning properly;

(d) storing data in a data storage device, said data being representative of the selection of said storage well selected in step (b);

(e) operating a transport mechanism, said transport mechanism adapted to transport said card extracted in step (c);

(f) detecting whether said card is transported by said transport mechanism in step (e);

(g) replacing said data stored in said data storage device in step(d) with data representative of detection of said card when said transport of said card is detected in step (f);

(h) reading said data stored in said data storage device a predetermined period of time after selecting said storage well in step (b);

(i) counting the number of times said data read in step (h) was not representative of said detection of said card, maintaining a separate count for each of said storage wells; and (j) alarming when the count obtained in step (i) exceeds a predetermined number.

14. An improved card shuffling device of the type having a plurality of storage wells, each of said storage wells adapted to hold a plurality of playing cards; an extraction means for extracting said cards from said storage wells on a one-at-a-time basis, the one of said storage wells on which said extraction means operates being determined by a signal; a random signal generator for generating said signal which determines the one of said storage wells on which said extraction means operates; and transport means for transporting said cards extracted from said storage wells, wherein the improvement comprises:

(a) sensing means for sensing the transport of one of said cards, said sensing means having means for generating a signal when said transport is sensed;

(b) a bistable device capable of assuming either of two stable output states depending on the most recent input to said bistable device, said bistable device having means for receiving said randomly generated signal and said sensing signal as inputs, whereby said bistable device assumes a first output state when it receives said randomly generated signal and a second output state when it receives said sensing signal;

(c) reading means for reading the output state of said bistable device, said reading means having means for generating a signal representative of said output state read from said bistable device;

(d) counter means for counting the number of times said reading means generates a signal representative of having read said first output state, said counter means having means for generating a signal when said count reaches a predetermined number; and (e) alarm means, said alarm means activated by said signal from said counter means.

* * * * *